US005470015A

United States Patent [19]

Jud

[11] Patent Number: 5,470,015

[45] Date of Patent: Nov. 28, 1995

[54] TUBULAR POUCH WITH OPENING AID

[75] Inventor: Wilfried Jud, St. Pölten, Austria

[73] Assignee: Teich Aktiengesellschaft, Obergrafendorf, Austria

[21] Appl. No.: 418,888

[22] Filed: Apr. 7, 1995

Related U.S. Application Data

[63] Continuation of Ser. No. 50,276, May 13, 1993, abandoned.

[30] Foreign Application Priority Data

Sep. 13, 1991 [AT] Austria ..... 1835/91

[51] Int. Cl.[6] ..... B65D 65/10; B65D 65/14; B65D 65/32

[52] U.S. Cl. ..... 229/87.05; 383/200; 383/211

[58] Field of Search ..... 229/87.05; 383/200, 383/207, 208, 209, 211

[56] References Cited

U.S. PATENT DOCUMENTS

| | | | |
|---|---|---|---|
| 3,410,393 | 11/1968 | Lee | 383/211 |
| 3,497,131 | 2/1970 | Tracy | 229/87.05 |
| 4,826,011 | 5/1989 | Jud | 229/87.05 |
| 5,184,771 | 2/1993 | Jud et al. | 229/87.05 |

FOREIGN PATENT DOCUMENTS

| | | |
|---|---|---|
| 0399420 | 11/1990 | European Pat. Off. . |
| 1566681 | 5/1969 | France . |
| 941418 | 4/1956 | Germany . |
| 959716 | 3/1957 | Germany . |
| 8425417.3 | 11/1984 | Germany . |
| 9005297.8 | 9/1990 | Germany . |
| 4013918A1 | 7/1991 | Germany . |
| 651795 | 10/1985 | Switzerland . |
| 804559 | 11/1958 | United Kingdom . |
| WO91/06488 | 5/1991 | WIPO . |

*Primary Examiner*—Stephen P. Garbe
*Attorney, Agent, or Firm*—Bacon & Thomas

[57] ABSTRACT

A tubular pouch is provided with a tear-open strip which begins at a U-shaped perforation formed in one of two edge strips of the pouch which are joined across a junction area by cold-sealing into tubular pouch fins. The U-shaped perforation defines a grip formed by the wrapping material inside it and includes legs extending toward and entering the junction area. However, in its remaining portion, the U-shaped perforation does not reach as far as the junction area and thereby manufacturing tolerances relating to the U-shaped perforation and the relief cold bondings as well as lateral shifts between the two edge strips cannot result in bonding of the grip. When the grip is pulled to open the wrap, the wrapping material tears from the ends of the perforation along approximately parallel lines. The grip can be advantageously folded over 180° in order to be readily grasped.

10 Claims, 3 Drawing Sheets

TUBULAR POUCH WITH OPENING AID

This application is a Continuation of application Ser. No. 08/050,276, filed May 13, 1993, now abandoned.

BACKGROUND OF THE INVENTION

1. Technical Field

The invention concerns a tubular pouch for piece goods, with an envelope formed by a planar, foldable wrapping material of which two edge-strips are joined together at their insides and in a junction area by a seal, preferably a peelable cold seal, a junction-free zone being present in this edge strip and comprising linear perforations forming the beginning of a tear-open strip. The tubular pouch is applicable foremost as a wrap for such foodstuffs as chocolates or stored cookies and bakery items.

2. State of the Art

A tubular pouch of this kind is known from published international patent application WO 91/06488. In this case the linear perforations consist of two cuts starting at the edge of one of the edge strips and advantageously extending into the junction area of the edge strips. The edge area forms a grip between these two cuts, and this grip forms the initially merely "virtual" tear-open strip. However it was found that when manufacturing these known tubular pouches, especially when making the tube from the length of wrapping material already fitted with cuts, this material on occasion will tear farther at the ends of the cuts if the machinery is adjusted less than optimally, and therefore the wrapping procedure will be interrupted.

SUMMARY OF THE INVENTION

The object of the invention is to create a tubular pouch wrapping of the initially described kind which is reliably secured against this undesired tearing of the ends of the linear perforations when the tubular pouch is being manufactured.

This basic problem of the invention is solved by the tubular pouch of the invention which is characterized in that the linear perforations subtend a U-line of which the legs point toward the junction area and which will not adjoin the junction area by a portion which may be the major part of their length, a spacing of at least 3 mm in the longitudinal direction of the pouch being possible between said portion, which may consist of the base of the U, and the junction area. Furthermore the edge strip comprising the U-shaped perforation may preferably project by a segment including most of the perforation beyond the free edge of the other edge strip.

In an advantageous embodiment of the invention, the ends of the legs of the U-perforation enter the junction area.

In a further advantageous embodiment, the tubular pouch of the invention is characterized in that the sealing layer is deposited in at least one portion of the junction area adjacent to the U-perforation onto one of the edge strips in the form of a relief coating enhancing the peelability of the seal, for instance in the form of a raised grid.

In still another advantageous embodiment, the tubular pouch of the invention is characterized in that the two edge strips are joined along their free edges and at least in the vicinity of the U perforation by an additional sealing zone parallel to the edges, the said sealing zone being at least 2 mm away from the U perforation as seen in the longitudinal pouch direction.

In a last advantageous embodiment of the tubular pouch of the invention, a segment enclosed on three sides by the U perforation and located at that strip where the U perforation is present will be folded outward on the surface of the wrapping.

BRIEF DESCRIPTION OF THE DRAWINGS

The invention is described below in relation to following drawings. Wherein the wrapping material is shown much thicker than it actually is for the sake of clarity.

DETAILED DESCRIPTION OF THE PREFERRED EMBODIMENTS

In the embodiment discussed below, the wrapping is manufactured from a three-ply material. Beginning at the outside of the wrapping, this material consists of an intensively biaxially stretched polypropylene foil, a printed aluminum foil 0.007 to 0.009 mm thick, a paper with a density of 30 to 100 g/m$^2$ and a latex-based, cold-bonding adhesive (2 to 7 g/m$^2$ solids). The polypropylene foil provides mechanical strength to the compound wrapping, the paper forms the substrate for the wrapping and the aluminum foil constitutes the ply ensuring gas hermeticity of this material.

The wrapping machine includes U-perforators for each pouch and for one of the edges of the band of wrapping taken off the supply roll with the perforation's legs pointing toward the center of the band of wrapping material. Directly thereafter the band of wrapping material is folded around the piece goods being continuously supplied, for instance waffles, its edges being sealed to each other within a junction strip and the two mutually sealed edge strips—which are called "fins"—are so bent back against the wrapping surface that the edge strip containing the U-perforation is outward. The tubular pouch enclosing the packaged goods is then provided, between every two consecutive goods, with two parallel cross-sealing seams and will then be divided into individual tube pouches by being transversely severed between the two cross-sealing seams. These cross-seals thereupon form the tubular pouch "fins" projecting from the wrap.

Figure 1:
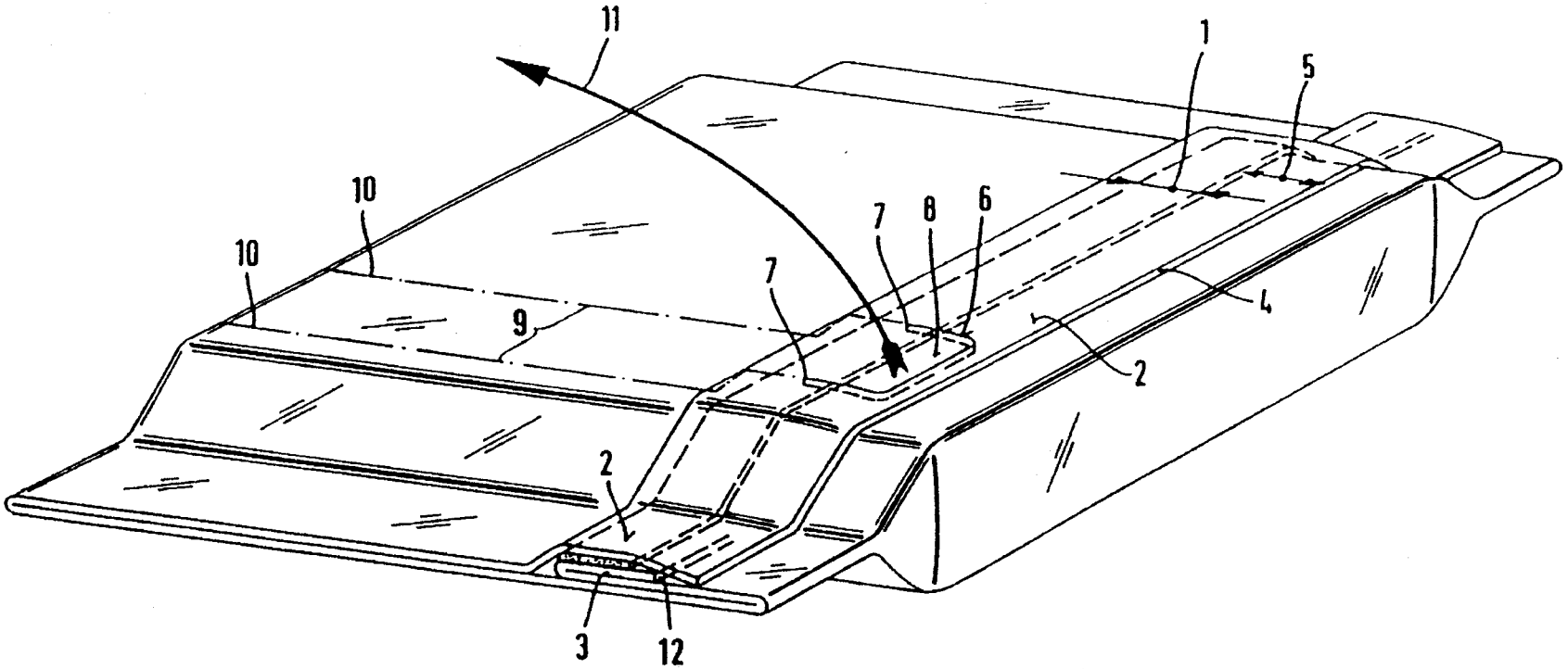
FIG. 1 is a schematic perspective view of a tubular pouch constructed in according with the present invention.

As generally stated above, FIG. 1 is a schematic perspective of a waffle tubular pouch made in this manner. The edge strips 2 and 3 are joined together by cold-sealing in a junction area 1 and are folded over as "fins" onto the surface of the wrap. The edge strip 2 is external and is wider than the edge strip 3, as a result of which there remains a connection-free zone 5 between the edge 4 and the connection area 1, the connection-free zones projecting beyond the edge strip 3 at the bottom. The U-shaped perforation 6 is present inside this connection-free zone 5 and extends by its leg ends 7 into the junction area 1. The perforation 6 may be either already present in the supplied band of wrapping material or it may be punched at the wrapping machine shortly before the tubular pouch is formed. The wrapping material forms a grip 8 in the connection-free zone 5 of the edge strip 2 and inside the U perforation 6, the grip 8 representing the beginning of a "virtual" tear-open strip 9 with mutually parallel boundary lines 10. When the package is opened, the grip 8 is pulled in the direction of the arrow 11, and upon suitable severing at the ends 7 of the U perforation, the wrap then tearing approximately along the boundary lines 10.

Figure 2:
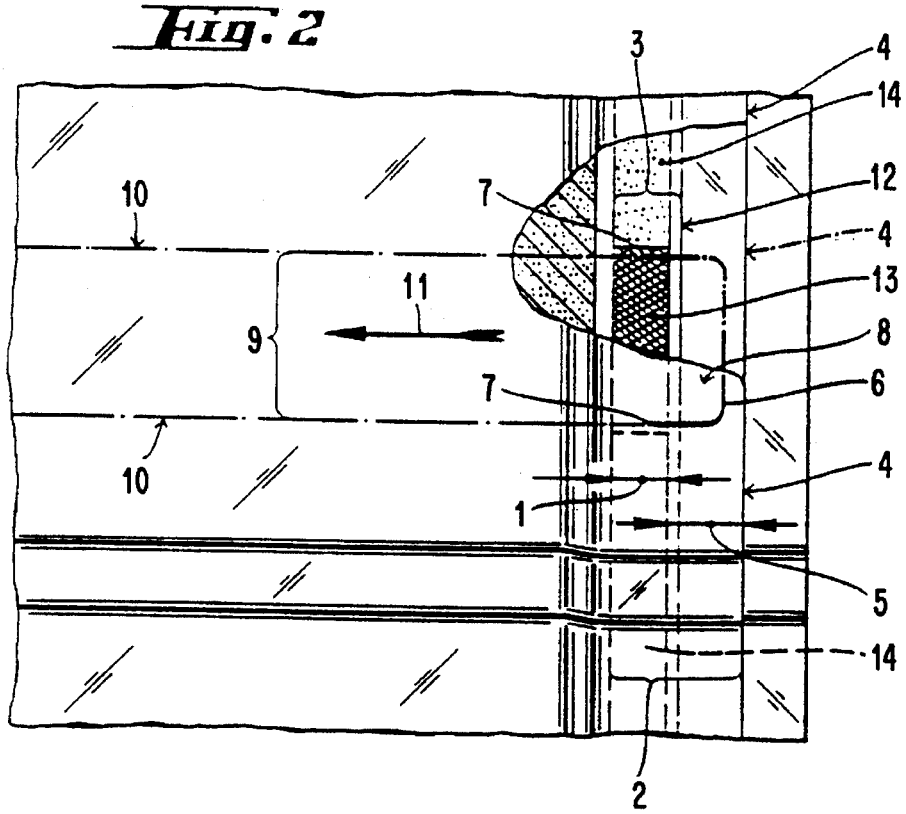
FIG. 2 is a partial top view of the tubular pouch of FIG. 1.

As stated generally above, FIG. 2 shows the tubular pouch in partial top view with the wrap already having been partly torn open at the site of the U perforation 6.

FIG. 2 also shows the edge 12 of the lower edge strip 3 beyond which projects the connection-free zone 5 of the edge strip 2. A cold-bonding adhesive is deposited in the form of a raised grid on the edge strip 2 in a segment 13 adjacent to the U perforation 6 entered by the U-perforation legs 7 and thereby the cold-bond peelability is higher in this segment 13 than in the remaining portion 14 of the junction area 1. As a result the tear-open strip 9 is more easily pulled off when opening the wrap.

Figure 3:
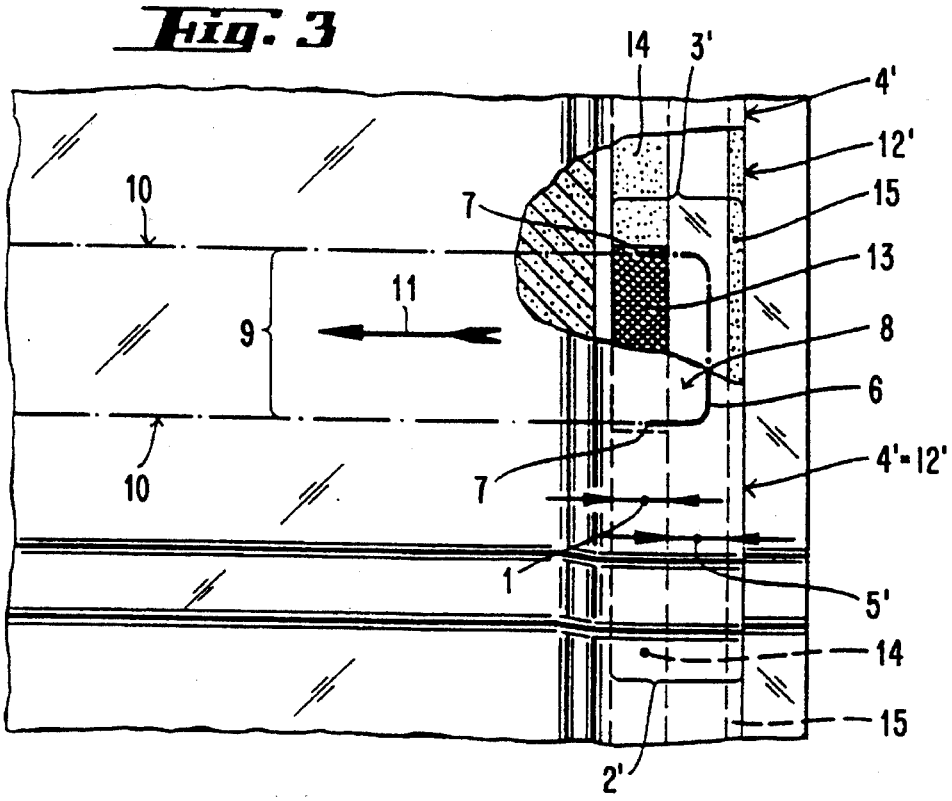
FIG. 3 is a partial top view similar to that shown in FIG. 2 but depicting another embodiment of the tubular pouch of the invention.

FIG. 3 is a view similar to FIG. 2 and shows another embodiment mode of the tubular pouch of the invention. FIG. 3 differs first in that the two edge strips 2' and 3' forming the bent-over "fins" are approximately the same width and are connected to each other along their free edges 4' and 12' in a narrow, additional junction zone 15 by cold bonding. As a result, the grip 8 being formed inside the arc of the U perforation in the wrap lifts slightly off the lower edge strip 3' and is more easily grabbed. A minimum spacing of 2 mm between the junction zone 15 and the perforation 6 is provided to reliably prevent the grip from bonding in the event of a mutual lateral shift between the two edge strips 2' and 3' when the tubular pouch is being formed.

In a further embodiment mode of the wrap of the invention (now illustrated) the junction-free zone 5' may assume a rectangular shape for instance instead of a strip-shape, a portion of the U perforation 6 not adjoining the junction area, such as a portion forming the U base being at least 3 mm from the contour of this rectangular junction-free area as seen in the longitudinal tubular pouch direction.

Figure 4:
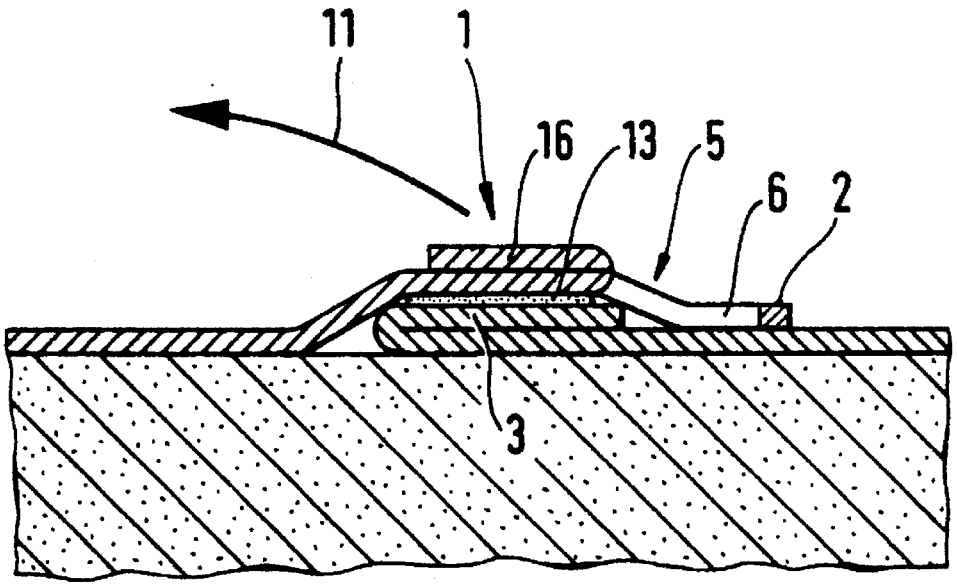
FIG. 4 is a partial cross-sectional view of a further embodiment of the tubular pouch according to the present invention.

In yet another embodiment of the tubular pouch, as shown in FIG. 4, during its manufacture or when providing the U perforation 6 in the band of wrapping material, a segment 16 of the edge strip 2 which is enclosed on three sides by the U perforation 6 is folded by 180°. Such folding is especially stable when the multi-ply wrapping material contains an aluminum foil and enables segment 16 to be readily grasped and pulled in the direction of arrow 11 in order to open the tubular pouch.

I claim:

1. A tubular pouch for piece goods comprising a wrap formed by a planar, foldable wrapping material of which two edge strips are joined together in a junction area by a sealing means with one of said edge strips overlying the other of said edge strips and defining an outer surface of said wrap, a junction-free zone being present in said one of said edge strips, said junction-free zone being provided with a U-shaped perforation forming the beginning of a strip-shaped tear-open strip, said U-shaped perforation including a base and two legs with the legs pointing toward the junction area, at least one portion of said U-shaped perforation being located outside of the junction area and a segment of said one of the edge strips, that is enclosed along three sides by said U-shaped perforation and is located within said junction-free zone, is externally folded onto the outer surface of said wrap atop said junction area.

2. Tubular pouch defined in claim 1, wherein a spacing of at least 3 mm in a longitudinal direction of the two edge strips is present between said at least one portion of said U-shaped perforation and the junction area.

3. Tubular pouch defined in claim 1, wherein the edge-strip comprising the U-shaped perforation projects beyond a free edge of the other edge strip by a segment constituting a major part of said U-shaped perforation.

4. Tubular pouch defined in claim 1, wherein the two legs of the U-shaped perforation have associated ends that extend into the junction area.

5. Tubular pouch defined in claim 1, wherein said sealing means comprises a cold-bonding agent that is deposited in a segment of the junction area adjacent to the U-shaped perforation, said cold-bonding agent being applied onto at least one of the edge strips in the form of a relief coating increasing the peelability of the sealing means.

6. Tubular pouch defined in claim 5, wherein the relief coating is in the form of a raised grid.

7. Tubular pouch defined in claim 1, wherein the two edge strips have associated free edges that are connected to each other in an additional sealing zone provided at least in the vicinity of the U-shaped perforation, said additional sealing zone being located a distance of at least 2 mm away from the U-shaped perforation in a direction perpendicular to a longitudinal direction of the two edge strips.

8. A tubular pouch for packaging piece goods comprising:

a substantially planar, foldable wrapping material defining first and second laterally spaced and longitudinally extending edge strips, each of said first and second edge strips having an associated width, said first edge strip longitudinally overlying said second edge strip in a first zone, said first edge strip including a longitudinally extending edge strip portion that extends laterally beyond said second edge strip into a second zone;

sealing means interposed between said first and second edge strips in said first zone to seal said first edge strip to said second edge strip in said first zone;

a tear-open strip formed in said first edge strip and extending laterally of said wrapping material, said tear-open strip including a generally U-shaped perforation that constitutes the beginning of said tear-open strip, said U-shaped perforation including a base portion and two longitudinally spaced leg portions, said U-shaped perforation being formed in said second zone with said leg portions extending toward said first zone, a portion of said U-shaped perforation being externally folded from said second zone onto the outer surface of said first edge strip within said first zone.

9. The tubular pouch defined in claim 8, wherein the edge strip portion of said first edge strip that extends laterally beyond said second edge strip into said second zone includes a terminal, longitudinally extending edge strip section that is secured to said wrapping material at a position laterally spaced from said second edge strip.

10. The tubular pouch defined in claim 9, wherein said U-shaped perforation is formed in said first edge strip laterally spaced, toward said first zone, from the terminal edge strip section of said first edge strip.

* * * * *